US006068495A

United States Patent [19]

Virchow

[11] Patent Number: 6,068,495

[45] Date of Patent: May 30, 2000

[54] SPARKING PLUG CONNECTOR FOR AN INTERNAL COMBUSTION ENGINE

[76] Inventor: Florian Virchow, Weingarten 7 a, D-29223 Celle, Germany

[21] Appl. No.: 09/155,122

[22] PCT Filed: Mar. 8, 1997

[86] PCT No.: PCT/DE97/00459

§ 371 Date: Sep. 18, 1998

§ 102(e) Date: Sep. 18, 1998

[87] PCT Pub. No.: WO97/36354

PCT Pub. Date: Oct. 2, 1997

[30] Foreign Application Priority Data

Mar. 22, 1996 [DE] Germany ..... 196 11 283

[51] Int. Cl.[7] ..... H01R 13/44

[52] U.S. Cl. ..... 439/125; 439/271

[58] Field of Search ..... 439/125–128, 439/271; 123/169 PA, 169 PH

[56] References Cited

U.S. PATENT DOCUMENTS

| | | | |
|---|---|---|---|
| 4,274,695 | 6/1981 | Fukumori et al. | 339/97 |
| 4,394,598 | 7/1983 | Bergmann | 313/51 |
| 4,824,385 | 4/1989 | Sturdevan | 439/128 |
| 4,994,259 | 7/1990 | Richardson | 439/125 |
| 5,181,856 | 1/1993 | Vente et al. | 439/125 |
| 5,297,971 | 3/1994 | Nitta et al. | 439/125 |
| 5,324,207 | 6/1994 | Itoh et al. | 439/125 |
| 5,391,100 | 2/1995 | Maruyama et al. | 445/7 |
| 5,878,706 | 3/1999 | Akamatsu | 439/125 |

FOREIGN PATENT DOCUMENTS

| | | | |
|---|---|---|---|
| 0248717 | 12/1987 | European Pat. Off. . | |
| 0433870 | 6/1991 | European Pat. Off. . | |
| 0488216 | 6/1992 | European Pat. Off. . | |
| 839285 | 5/1952 | Germany . | |
| 3302878 | 8/1984 | Germany . | |
| 0412486 | 1/1992 | Japan | H01T 13/04 |

*Primary Examiner*—Gary F. Paumen

*Attorney, Agent, or Firm*—Hedman, Gibson & Costigan, P.C.

[57] ABSTRACT

The invention relates to a spark plug connector for an internal combustion engine, comprising a plug-in contact (28) for the electrode connection of a spark plug;

a connector sleeve (3) surrounding the plug-in contact (28);

a connection (32) for an ignition cable;

a single-piece, rigid, supporting connector sleeve (3) made of an insulating material; and an elastic means (20) attached to the connector sleeve (3) which seals the gap (22) between the connector sleeve and a spark plug well of an engine cylinder, with the spark plug connector being guided in the spark plug well by the elastic means, in which a) the material of the connector sleeve (3) has a high melting point and a high electric strength;

b) the gap between the connector sleeve (3) and the ceramic shaft of the spark plug is sealed by an elastic means (17) attached to the connector sleeve, by which means the spark plug connector is guided during plug-in onto the spark plug;

c) in the connector sleeve (3) a ceramic inlet (7) is provided which encloses the plug-in contact (28) and the ignition cable connection (32), with the plug-in contact (28) and the ignition cable connection (32) being embedded in the ceramic inlet (7) in such a way that the ceramic part in axial direction protrudes beyond the plug-in contact (28) and the connection (32) for the ignition cable.

7 Claims, 2 Drawing Sheets

SPARKING PLUG CONNECTOR FOR AN INTERNAL COMBUSTION ENGINE

The invention relates to a spark plug connector for an internal combustion engine, comprising

- a plug-in contact for the electrode connection of a spark plug;
- a connector sleeve surrounding the plug-in contact;
- a connection for an ignition cable;
- a single-piece, rigid, supporting connector sleeve made of an insulating material; and
- an elastic means attached to the connector sleeve which seals the gap between the connector sleeve and a spark plug well of an engine cylinder, with the spark plug connector being guided in the spark plug well by the elastic means;
- an elastic means attached to the connector sleeve which seals the gap between the connector sleeve and the ceramic shaft of the spark plug;
- a ceramic inlet provided in the connector sleeve, which ceramic inlet encloses the plug-in contact and the ignition cable connection, with the plug-in contact and the ignition cable connection being embedded in the ceramic inlet in such a way that the ceramic part in axial direction protrudes beyond the plug-in contact and the connection for the ignition cable.

When many years ago gas was discovered as a fuel for industrial spark ignition engines, various engine manufacturers converted their diesel engines to gas engines, with the diesel injector nozzles being replaced by spark plugs. These spark plugs were located very deep in the so-called spark plug well, i.e. where previously the tip of the injector nozzle was installed in the cylinder head. A connection to the ignition coil was established by insulated or uninsulated metal extensions and an additionally plugged-on ignition cable.

With the usual ignition voltages at this time, up to 15 kV maximum, the existing gap in the spark plug wells provided sufficient insulation.

The emission ordinance TA-Luft ("Technical Instruction for the Prevention of Air Pollution") enacted in the meantime imposes lower NOx and CO levels. These lower levels could only be achieved by an engine operating on a lean mixture. This meant that the engine designers had to create an excess of air in the combustion chamber. To achieve this, carburetion was optimised. This also included the development of four-valve cylinder heads. Increasing the number of valves resulted on the one hand in a reduction in the diameter of the spark plug wells, and on the other hand in an increased voltage requirement at the electrodes because the lean mixture was more difficult to ignite. Ignition voltage was increased to approximately 40 kV.

This leads to extremely unfavourable operating conditions including the requirement to conduct high voltages along extended distances in the narrow spark plug well. Frequent arcing is still the order of the day, in particular if the electrode gap of the spark plug reaches a certain dimension. Most of the time such arcing occurs between the spark plug or spark plug extension and the spark plug well; arcing leads to misfiring.

In order to improve the operational behaviour, the use of silicon-sheathed spark plug connectors was proposed, with the said spark plug connectors requiring insertion into the deep spark plug well by means of special pliers until they engaged the spark plug. Such installation was extremely difficult and resulted in the ignition cables being destroyed during de-installation. In addition, high maintenance costs were incurred.

From DE 29 04 007 C2 the combination of a hollow-cylinder insulating sleeve made of soft material is known, with a cylindrical retainer made of a heat-resistant, hard insulating material such as Bakelite or hard rubber, to avoid radiated interference in the case of a spark plug connector. However, the electric strength of such material combinations is insufficient.

From DE 38 35 984 A1 a spark plug connector is known in which an insulating elastomeric shoe comprises a rigid cover made of a thin, firm insulating material such as plastic. This combination only improves removal of the spark plug connector, without increasing the electric strength.

From DE 33 02 878 A1 a spark plug connector is known which comprises a single-piece, rigid, supporting and elastic insulation sleeve. The insulation sleeve comprises an insulating body made of thermoset material or thermoplastic material, which insulation sleeve by spray-application directly envelopes a constructional unit comprising an interference eliminating resistor, a connection component of the ignition cable, and contact component for the spark plug. The insulation sleeve can be inserted into the spark plug well of an engine cylinder by means of a plug-on adapter with an annular sealing flange, with the said connector sleeve being elastically sealed against the said engine cylinder. In this way, the plugging-on of the spark plug connector is intended to be facilitated.

From EP 0 488216 A2 and U.S. Pat. No. 5,391,100 the use of a hard artificial resin with excellent heat resistance and electrical insulation, as a material for the connector sleeve, is known.

DE-PS 839 285 discloses a spark plug connector with a ceramic insulating body enclosing a plug-in contact for the electrode connection of a spark plug and a connection for an ignition cable.

DE-PS 29 48 043 and JP 4-12 486 A discloses the sealing, elastic guidance of the spark plug connector in the spark plug well of an engine cylinder or the connector sleeve on the ceramic shaft of the spark plug.

From EP 0 433 870 A1 a spark plug connector for motor vehicle engines is known in which the ignition cable connection, a discharge tube and part of a connecting component to the spark plug are embedded in a thermoplastic material, with additionally a protective tube made from an inorganic material such as ceramic or glass covering the said spark plug connector. Such embedding which is intended to provide better protection against corona discharge, does not meet higher requirements.

In addition, the use of ceramic-sheathed spark plug extensions was proposed. However since there are only ceramic sleeves available on the market which are intended as heat shields for thermal elements, their economical porous design cannot provide adequate resistance to high voltage.

Due to the CE certification standard, gas engines must not exceed certain interference-frequency limits. However, due to their unshielded conducting of high voltages, the high tension cables used represent giant aerials.

It is the object of the invention to provide a spark plug connector for internal combustion engines, comprising high heat resistance, increased breakdown safety and an extended serviceable life; which keeps away dirt and moisture from the spark plug well and from the insulator of a spark plug, which suppresses radiated interference as far as possible and which is easy to install.

According to the invention, this object is met by combining the following features:

a) the connector sleeve in the area of the ceramic inlet comprises several shoulders in whose areas the ceramic inlet and the sleeve material of the connector sleeve adjoin all around in a positive fit.

a) the material of the connector sleeve has a high melting point and a high electric strength, corresponding to those of polytetrafluoroethylene (PTFE).

If the connector sleeve in the receiving area of the ceramic inlet comprises several shoulders in whose areas the ceramic inlet and the sleeve material of the connector sleeve adjoin all around in a positive fit, then a further cause for possible breakdown is eliminated because any gaps between the ceramic inlet and the connector sleeve are avoided or interrupted.

A further embodiment of the invention provides for the axial extremities of the ceramic inlet, in the contact areas where they touch the shoulders in axial direction, to adjoin in a positive fit, the connector sleeve enclosing the ceramic inlet sleeve. In this case too, gaps and edges which may cause breakdowns are avoided.

In a further embodiment of the invention a radial restraint is added to this axial restraint, in such a way that the surface of the sheath of the ceramic inlet along the length of the sheath, in a positive fit, radially touches by its shoulders the spaced apart contact areas of the connector sleeve surrounding the sheath surface. This results in several contact surfaces, spaced apart, between the ceramic inlet and the connector sleeve, by means of which misfiring is suppressed to a very significant degree.

A sleeve material comprising a rigid, insulating material with a high melting point and high electric strength such as polytetrafluoroethylene can easily be shaped and adapted to any desired forms of spark plug wells. A connector sleeve made of such material, which sleeve extends through the gap to the spark plug well, significantly increases the breakdown resistance if it is sealed from the spark plug well on the one hand and the spark plug on the other hand. The ceramic inlet itself provides further protection to the plug-in contact for the spark plug and the ignition cable connection, against arcing in longitudinal and lateral direction. This also increases breakdown resistance.

Up to now, the voltage to be provided by the ignition coil for the spark to find its way to the mass, was determined by the engine parameters, such as temperature, pressure, mixture formation in the cylinder and electrode gap of the spark plug. If the ignition voltage supplied by the ignition coil to the electrode drops as a result of losses in the connection, in particular in transition areas such as at the plug-in contact and at the ignition cable connection, then there is the danger of electrode bridge formation which prevents the generation of an ignition spark. Misfiring results. The spark plugs will need to be replaced. As a result of the high electric strength and the optimal shielding of the ignition voltage against mass, achieved according to the invention, it is now possible to provide a high ignition voltage of approximately 50–60 kV at the electrode thus ensuring safe ignition, because as a result of good shielding, no leakage currents and/or arcing occur at other points. There are no electrode bridges, thus significantly prolonging the serviceable life of the spark plug. Extension of the serviceable life is at a magnitude of 3 to 5 times that of known ignition connections.

Apart from extending the serviceable life of spark plugs, the ignition connection comprising the ignition cable with the integrated plug connector offers the additional advantage of avoiding consequential damage as a result of misfiring. Gas engines are fitted with catalytic converters to reduce emissions. These catalytic converters are sensitive to misfiring. If as a result of misfiring, non-combusted gas flows through a catalytic converter, this can destroy the catalytic converter. If misfiring is avoided by means of the ignition connection according to the invention, the catalytic converter is saved.

It is advantageous if within the ceramic inlet in the leads between the plug-in contact and the ignition cable connection an ohmic resistor is provided, as is known from DE 33 02 878 A1. The resistor suppresses electrical malfunctions. However it is equally important that this ohmic resistor reduces the spark duration and the spark decay time. By keeping the spark duration and the subsequent spark decay time short, material removal from the spark plugs can be reduced, thus increasing the serviceable life of the spark plugs. It is advantageous if the value of the resistor is approximately 5 kOhm.

A further embodiment of the invention provides for all electrically conducting components to be of extremely round shape. Since ignition sparks always tend to spark over in pointed positions first, the inclination to arc over is reduced.

A further embodiment of the invention provides for the exterior of the connector sleeve to comprise an O-ring which closes the gap between the exterior of the connector sleeve and the wall of the spark plug well, with ventilation slots extending in longitudinal direction of the connector sleeve, between its outer sheathing and the O-ring. This prevents the formation of condensation in the gap, which can occur in spite of preventing access to dirt. In addition, overpressure can be evened out in spite of the gap being sealed. Oil, dirt and humidity which are among the major contaminants, are thus prevented from lodging in the spark plug well. Sealing can also take place by means of another heat-resistant component, in particular a silicon material.

From DE 41 01 375 C1 it is known to keep away humidity from the gap between the connector sheathing and the ignition cable, by means of a roll ring.

It is also advantageous if in the area of the connector base at the interior wall of the sleeve at least one O-ring is provided, with the exterior diameter of the said O-ring being such that it provides a tight seal against the ceramic collar of a spark plug. This seal which is known from EP 0 248 717 protects the ceramic collar of a spark plug from contamination, thus preventing the occurrence of an increased transition resistance between the plug-in contact and the spark plug. The seal also prevents leakage current moving down along the insulator which would cause misfiring in the engine compartment. Here again, instead of an O-ring, a silicon component, for example a silicon tube, might be considered for use.

A further embodiment of the invention provides for all components such as connector sleeve, ceramic inlet, seals, plug-in contact, ignition cable and similar, as far as is possible to comprise a silicon sheath. This results in an extremely high electrical breakdown resistance of all components.

Below, the invention is further illustrated by means of a drawing, as follows:

ceramic inlet and the connector sleeve, which gaps may cause instances of breakdown, are avoided.

A further embodiment of the invention provides for the axial extremities of the ceramic inlet, in the contact areas where they touch the shoulders in axial direction, to adjoin in a positive fit, the connector sleeve enclosing the ceramic inlet sleeve.

In a further embodiment of the invention a radial restraint is added to this axial restraint, in such a way that the surface of the sheath of the ceramic inlet along the length of the sheath, in a positive fit, radially touches by its shoulders the spaced apart contact areas of the connector sleeve surrounding the sheath surface. This results in several contact surfaces, spaced apart, between the ceramic inlet and the connector sleeve, by means of which misfiring is suppressed to a very significant degree.

Below, the invention is further illustrated by means of a drawing, as follows.

Figure 1:
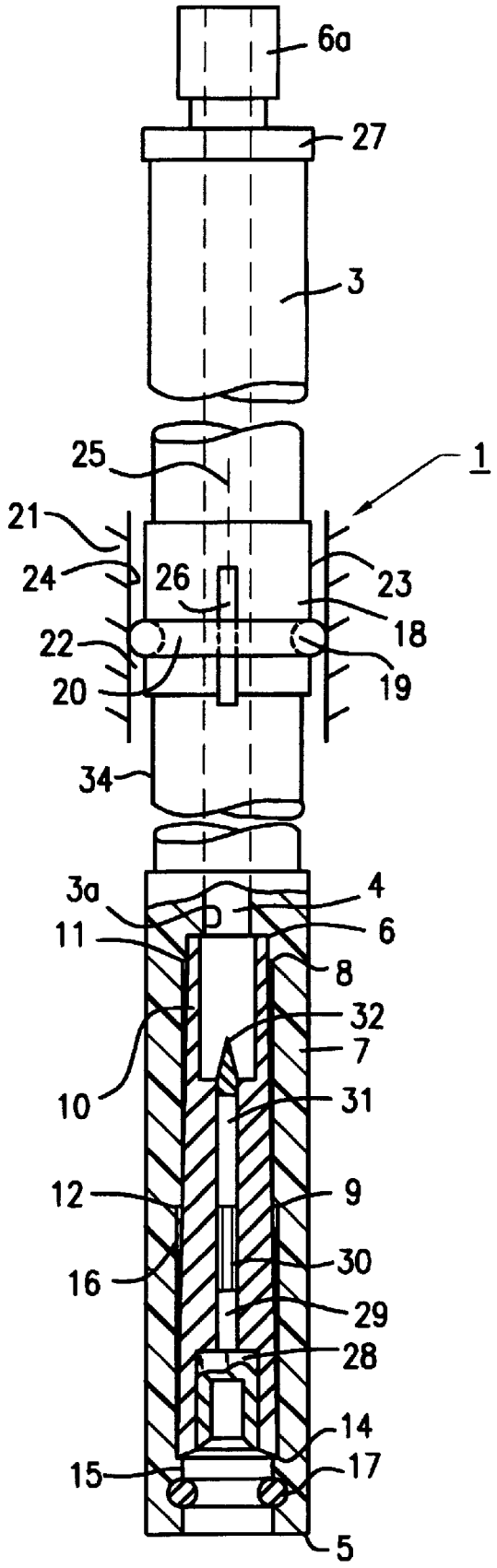
FIG. 1 shows a partial section of a spark plug connector for the ignition connection of an internal combustion engine, to a spark plug.

The spark plug connector 1 according to FIG. 1 comprises a supporting connector sleeve 3 made of a plastic material with a high melting point and a high electric strength. Presently a suitable material for this is polytetrafluoroethylene (PTFE). The material of the connector sleeve 3 is approximately 5 mm thick. The connector sleeve 3 is of single-piece design comprising a central longitudinal bore 4 extending from the connector base 5 to the connector head 6*a*. In the area of a ceramic inlet 7 in the direction of the connector base 5, the bore 4 is enlarged in steps, comprising shoulders 6, 8, 9. The first shoulder 6 forms an axially internal end stop for the ceramic inlet 7. The diameter of the internal wall 3*a* of the connector sleeve 3 is enlarged in steps in the area of the ceramic inlet 7 at shoulders 8 and 9, in such a way that the exterior sheath surface 10 of the ceramic inlet 7, at shoulders 8 and 9 adjoins around its entire circumferential area, all around with a positive fit and sealing along ring-shaped contact surfaces 11 and 12, against the material of the connector sleeve 3. Thus, spaced apart, the shoulders 8 and 9 repeatedly provide a safe positive fit, thus leading to increased breakdown resistance.

With the ceramic inlet 7 in place, at the extremity near the connector base, this ceramic inlet 7 is secured by a recessed shoulder step 14 in whose interior wall 15 the diameter of the bore 4 is reduced in comparison to the diameter of the wall area 16 in front of it. In this way the ceramic inlet 7 is firmly seated in a positive fit in the connector sleeve 3 between the shoulders 6 and 14, also in longitudinal direction 25. In the area of the connector base 5, at the interior wall 15, an O-ring 17 is provided whose external diameter is such that it can provide a seal against the ceramic collar of a spark plug (not shown). In such a way the plug-in contact 28 is protected against contamination which can cause an increase in the transition resistance at this position. In addition, the O-ring 17 provides an elastic guide at the spark plug for the connector sleeve 3. This is important because the engine vibrates during operation and unattenuated vibrations can damage the plug-in contact 28. By means of O-ring 17, free vibrations between the connector sleeve 3 and the spark plug are suppressed.

Figure 3:
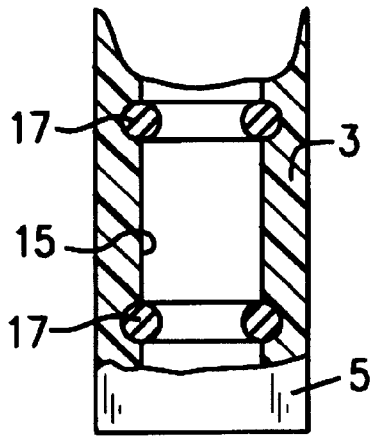
FIG. 3 shows a modified connector base of the spark plug connector with two O-ring seals.

FIG. 3 shows a modified spark plug connector base 5. This connector base 5 is longer than that according to FIG. 1, as far as this is compatible with the spark plug. For improved suppression of free vibration movements between the spark plug connector and the spark plug, in this case two O-rings 17 are provided, spaced apart.

In a middle region 18 the connector sleeve 3 comprises a snap-ring groove 19 into which a further O-ring 20 is inserted. This O-ring 20 ensures that the gap 22 between the external wall 23 of the connector sleeve 3 and the spark plug well 24 is closed off so as to keep out contamination such as oil, dust and the like. In longitudinal direction 25 of the connector sleeve 3, in the area of the O-ring 20, longitudinal grooves 26 are provided, to provide ventilation and pressure equalisation. Near connector head 6*a* there is a pull ring 27 which enables improved gripping of the connector sleeve 3. This pull ring 27 is intended for the mechanic, so as to prevent pulling by the ignition cable 33 and thus pulling off the ignition cable 33.

While the connector sleeve 3 is made from PTFE which has a high breakdown resistance and is easy to clean and easy to shape, the ceramic inlet 7 comprises a ceramic sleeve from a material which itself also has a high breakdwon resistance. The plug-in contact 28 is inserted into the ceramic inlet 7. Plug-in contact 28 and ignition cable connection 32 are recessed in the ceramic inlet 7. Thus, in the direction of the connector base 5, the ceramic component protrudes beyond the plug-in contact 28, and in the direction of the connector head 6*a* it protrudes beyond the ignition cable connection 32. The plug-in contact 28 changes into a conductive pin 29 which is connected to an ohmic resistor of approximately 5 kOhm. The resistor 30 reduces interference voltage and reduces the spark duration as well as spark decay time. The resistor 30 in turn comprises a connection pin 31 ending in a connecting piece 32 to which the ignition cable 33 is attached, for example by pressing it on. In this way the ignition cable 33 and the spark plug connector form an installation unit.

Of importance are the material combinations, with the interior being a ceramic material and the exterior being PTFE, and the breakdown-resistant connection between the two materials, and the sealing O-rings. This ensures high breakdown resistance. An additional improvement is achieved in that all metallic parts are rounded off to avoid spikes.

A further increase in the breakdown resistance can be achieved in that both the exterior sheath 10 of the ceramic inlet 7, the exterior sheath 22 of the connector sleeve 3 and the ignition cable 33 comprise a silicon sheath 34, as indicated in FIG. 1.

Figure 2:
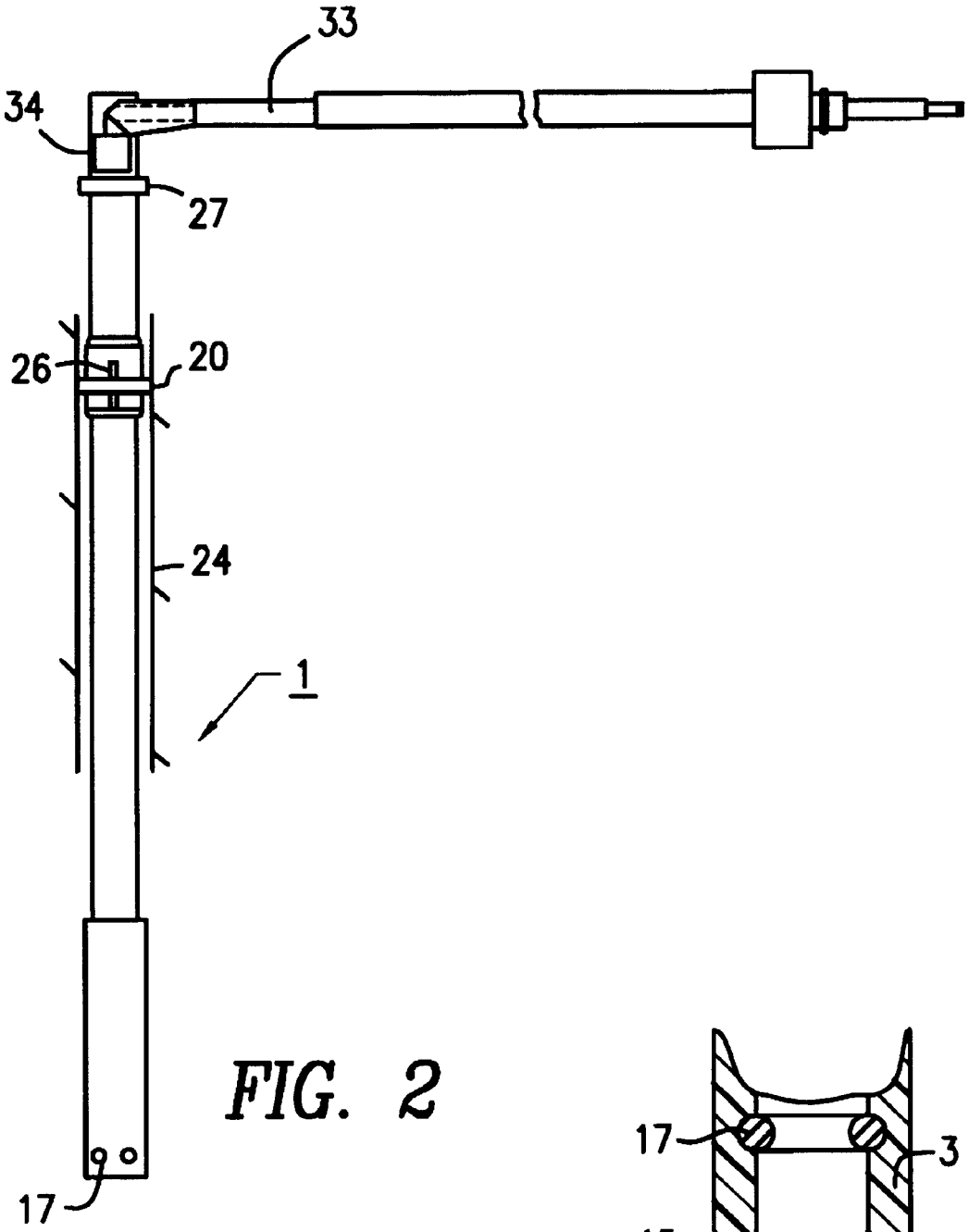
FIG. 2 shows the spark plug connector with an ignition cable connected.

FIG. 2 shows a top view of the ignition connection comprising the spark plug connector 1, a plugged-on connector cap 34 and the ignition cable 33. Also shown is the pull ring 27 by means of which the spark plug connector 1 can be pulled from a spark plug well, and the O-ring 20 which seals the spark plug well 24.

The ignition connection is preferably provided for operation with 50–60 kV; it is characterised by a significantly improved breakdown resistance and significantly improved serviceable life.

FIG. 3 shows a sectional view of an extension of the connector base 5 of the connector sleeve 3. With this embodiment, two O-rings 17, spaced apart, are provided. The second O-ring 17 improves vibration security in those instances where the collar of the spark plug is sufficiently long.

What is claimed is:

1. A spark plug connector for connecting to a ceramic shaft spark plug for use in a spark plug well of an engine cylinder in an internal combustion engine, comprising:

a plug-in contact for the electrode connection of a spark plug;

a single-piece, rigid, supporting connector sleeve surrounding the plug-in contact and made of an insulating material;

a connection for an ignition cable;

a first elastic means attached to the connector sleeve which seals a gap between the connector sleeve and the spark plug well, with the spark plug connector being guided in the spark plug well by the elastic means, a second elastic means attached to the connector sleeve which seals a gap between the connector sleeve and the ceramic shaft of the spark plug;

a ceramic inlet provided in the connector sleeve which encloses the plug-in contact and the ignition cable connection, whereby the plug-in contact and the ignition cable connection are embedded in the ceramic inlet such that the ceramic inlet axially protrudes beyond the plug-in contact and the ignition cable connection, further characterized by:

a) the connector sleeve in the area enclosing the ceramic inlet comprises shoulders for providing a positive fit between the ceramic inlet and the sleeve material of the connector sleeve; and b) the material of the connector sleeve has a high melting point and a high electric strength.

2. A spark plug connector according to claim 1, characterized in that the ceramic inlet comprises axial extremities for touching the shoulders for axial fixation, in axial direction to adjoin the ceramic inlet in a positive fit in the portion of the connector sleeve enclosing the ceramic inlet.

3. A spark plug connector according to claim 1 or 2, characterized in that ceramic inlet comprises a sheath for radially touching the shoulders for radial fixation along the length of the sheath to provide a positive fit with the portion of the connector sleeve surrounding the sheath surface.

4. A spark plug connector according to one or several of claims 1 to 3, characterised in that all electrically conducting components are of extremely round shape.

5. A spark plug connector according to claim 1, wherein the first elastic means comprises an O-ring and wherein the connector sleeve is further provided with ventilation slots extending in longitudinal direction of the connector sleeve, between the outer sheathing of the connector sleeve and the O-ring.

6. A spark plug connector according to claim 5, wherein the connector sleeve, ceramic inlet, first elastic means, second elastic means, plug-in contact, and ignition cable comprise a silicone sheath.

7. A spark plug connector according to claim 1 wherein the connector sleeve in the area enclosing the ceramic inlet comprises four shoulders for providing a positive fit between the ceramic inlet and the sleeve material of the connector sleeve.

* * * * *